US005969660A

United States Patent [19]

Veazey

[11] Patent Number: 5,969,660

[45] Date of Patent: Oct. 19, 1999

[54] INFLATABLE RADAR REFLECTORS

[75] Inventor: Sidney E. Veazey, King George, Va.

[73] Assignee: S E Ventures, Inc., King George, Va.

[21] Appl. No.: 09/041,928

[22] Filed: Mar. 13, 1998

Related U.S. Application Data

[60] Continuation-in-part of application No. 08/610,368, Mar. 4, 1996, Pat. No. 5,736,954, which is a division of application No. 08/129,770, Sep. 30, 1993, Pat. No. 5,530,445.

[51] Int. Cl.[6] ..... H01Q 15/20

[52] U.S. Cl. ..... 342/8; 342/10

[58] Field of Search ..... 342/8, 10, 5, 7, 342/9

[56] References Cited

U.S. PATENT DOCUMENTS

| | | | |
|---|---|---|---|
| 2,463,517 | 3/1949 | Chromak | 342/8 |
| 2,534,716 | 12/1950 | Hudspeth et al. | 342/8 |
| 3,130,406 | 4/1964 | Jones-Hinton et al. | 342/8 |
| 3,217,325 | 11/1965 | Mullin | 342/8 |
| 3,224,001 | 12/1965 | Rudnofsky et al. | 342/10 |
| 3,283,328 | 11/1966 | Wood | 342/8 |
| 3,749,337 | 7/1973 | Jalbert . | |
| 4,178,867 | 12/1979 | Shyu . | |
| 4,497,272 | 2/1985 | Veazey . | |
| 4,553,037 | 11/1985 | Veazey . | |
| 4,729,530 | 3/1988 | Jalbert . | |
| 4,768,739 | 9/1988 | Schnee | 244/146 |
| 5,174,529 | 12/1992 | Jalbert . | |
| 5,285,213 | 2/1994 | Tusch | 342/8 |
| 5,398,032 | 3/1995 | Tucker et al. | 342/8 |

OTHER PUBLICATIONS

U.S. Coast Guard —"Getting Help on the Water", pamphlet; COMDTPUB P–6101.3.

46 CFR 160.072 —"Distress Signals for Boats, Orange Flag" (1979).

S.E. Veazey & Prof. M. Saarlas, Rept. EW–11–83, "MASTLESS SAILS" (1982).

U. S. Naval Academy Div. of Engineering & Weapons (esp. pp. 2, 14, 17).

*Primary Examiner*—Daniel T. Pihulic

*Attorney, Agent, or Firm*—James K. Poole

[57] ABSTRACT

Inflatable radar reflectors comprising three mutually orthogonal radar reflective planes incorporated within the structure thereof can take the form of a teardrop, a cylindrical drogue or a set of three intersecting discs. A preferred embodiment includes three inflatable hollow toruses of flexible material which mutually intersect in a manner such that their planes are mutually orthogonal and each intersection provides a passage for air to pass between the intersecting sections thereof, inflation means for filling the three toruses simulataneously and collapsible circular panels of radar-reflective material covering each torus so that they form mutually orthogonal radar reflective planes. The preferred embodiment can be encased in a radar permeable balloon.

9 Claims, 4 Drawing Sheets

INFLATABLE RADAR REFLECTORS

This application is a continuation-in-part of Applicant's U.S. Ser No. 08/610,368, now U.S. Pat. No. 5,736,954, which is a divisional of U.S. Ser. No. 08/129,770, now U.S. Pat. No. 5,530,445. Both of these applications and patents are incorporated herein by reference.

BACKGROUND OF THE INVENTION

1. Field of the Invention

The present invention relates to distress or emergency signalling devices, for use on sea or land, which are lifted into the air by lighter-than-air balloons, sails, or particularly by means including a parafoil such as used by sport parachutists. The invention further relates to inflatable radar reflectors for use as distress signal devices.

2. Description of the Prior Art

Increasingly popular among outdoor sports are boating, hiking, cross-country skiing and the like. One factor such sports have in common is the possibility of participants becoming lost or other distress situations which require signalling the outside world for help and perhaps employing survival techniques while awaiting rescue. A variety of signals may be used for day and/or night signalling.

Brynjegard's U.S. Pat. No. 4,149,304 discloses orthogonal radar reflectors for use as emergency radar reflectors. A further account of the prior art is provided in the parent applications.

Despite the availability of a variety of distress signals, there is growing demand for signals which may be more effective, convenient and useful, preferably qualifying for Coast Guard certification.

SUMMARY OF THE INVENTION

An object of the present invention is to provide distress signals useful for day and/or night use from sea or land which are convenient and economical to use. A further object is to obtain increased range for the visibility of such distress signals by providing means to increase their altitude. Another object is to provide convenient, compact and economical means for recreational boaters and others to easily carry such distress signals. Still another object is to provide airborne radar reflectors which are portable, inflatable and can be used for a variety of purposes in addition to serving as distress signals.

These and other objects and advantages of the present invention will be apparent to those skilled in the art upon perusing the following detailed description, including the drawings, specification and appended claims.

According to the present invention, these and other objects can be achieved by providing an inflatable radar reflector having three orthogonal reflective surfaces therein. The radar reflective surfaces are preferably integrated into the structure of the radar reflector.

A preferred form of prior art radar reflector for use as a distress signal is a folding version which comprises three round discs which interlock in a mutually orthogonal manner. One in production is called a Davis emergency radar reflector. Applicant has developed a collapsible inflatable version of such a reflector in which the discs comprise inflatable hoops having thin, flexible radar reflective material stretched therein, the hoops mutually intersecting each other to provide three orthogonal surfaces and an interconnecting air cavity which can be inflated from a single inlet. The resulting inflatable reflector can optionally be encased in a large radar-permeable balloon which protects it both before and after inflation (the outer balloon being inflated so as to shield the reflector and hold the components rigidly in place). The outer balloon an be either elastic or inelastic, using a material such as Mylar.

Other embodiments of the folding radar reflectors of the present invention include a teardrop-shaped reflector having a conical inflatable section at the tail end and a cylindrical drogue reflector. The teardrop reflector comprises a frame made up of two elongated, teardrop-shaped frame members made of a rigid material and having radar reflective material stretched across the frame members to form radar reflective planes. The resulting planes are perpendicular to each other, and a square transverse member of a radar reflective mesh material is fastened to the two frame members so as to form a set of mutually orthogonal radar reflective planes. An inflatable conical section of radar-permeable material covers at least a portion of the tail of the reflector to inflate when exposed to any airflow.

The inflatable drogue embodiment comprises an open cylinder of radar-permeable material enclosing two mutually perpendicular radar reflective surfaces extending for at least a portion of the cylinder's length and a circular plane of radar reflective mesh material secured inside the cylinder and perpendicular to the two previous perpendicular planes, forming a set of mutually orthogonal radar reflective planes. The cylinder can be shaped and supported by at least two springy rings inside the cylinder's radar-permeable material.

Suitable fabrication materials include metallized polymeric films (such as aluminized Mylar) and fabrics such as polyesters and the like. Light reflection can be obtained by using reflective coatings of metal, metal paint, or the like.

DETAILED DESCRIPTION OF THE INVENTION

As should be apparent from the above summary of the invention and the following disclosure, the radar reflectors of the present invention are components of an integrated system or series of kits for assembling a variety of distress signal devices offering greater altitude and thus greater range of visibility and detection. The radar reflectors of the present invention are also useful for a multitude of applications requiring radar reflectors, particularly where portability and compact storage is desirable. The radar reflectors of the invention are all inflatable in that they can be filled with and retain air or other gases, or will gather air when subjected to an airflow, thus achieving the same effect in operation.

Radar-reflective material can be incorporated in the parafoil of the parent applications to make it an effective radar target, and Applicant has found that optimum results are obtained when radar reflective materials (e.g., aluminized Mylar) are included in the natural structural features of the parafoil so as to form three mutually orthogonal planes. The remaining surfaces and components of the parafoil are made of nylon, polyester or other radar-permeable fabrics or films. This configuration provides for omnidirectional retroreflection of radar waves; in other words, radar waves striking the parafoil from any azimuth will be reflected back to the source. The same principles of course apply to the inflatable radar reflectors of the present invention.

Figure 1:
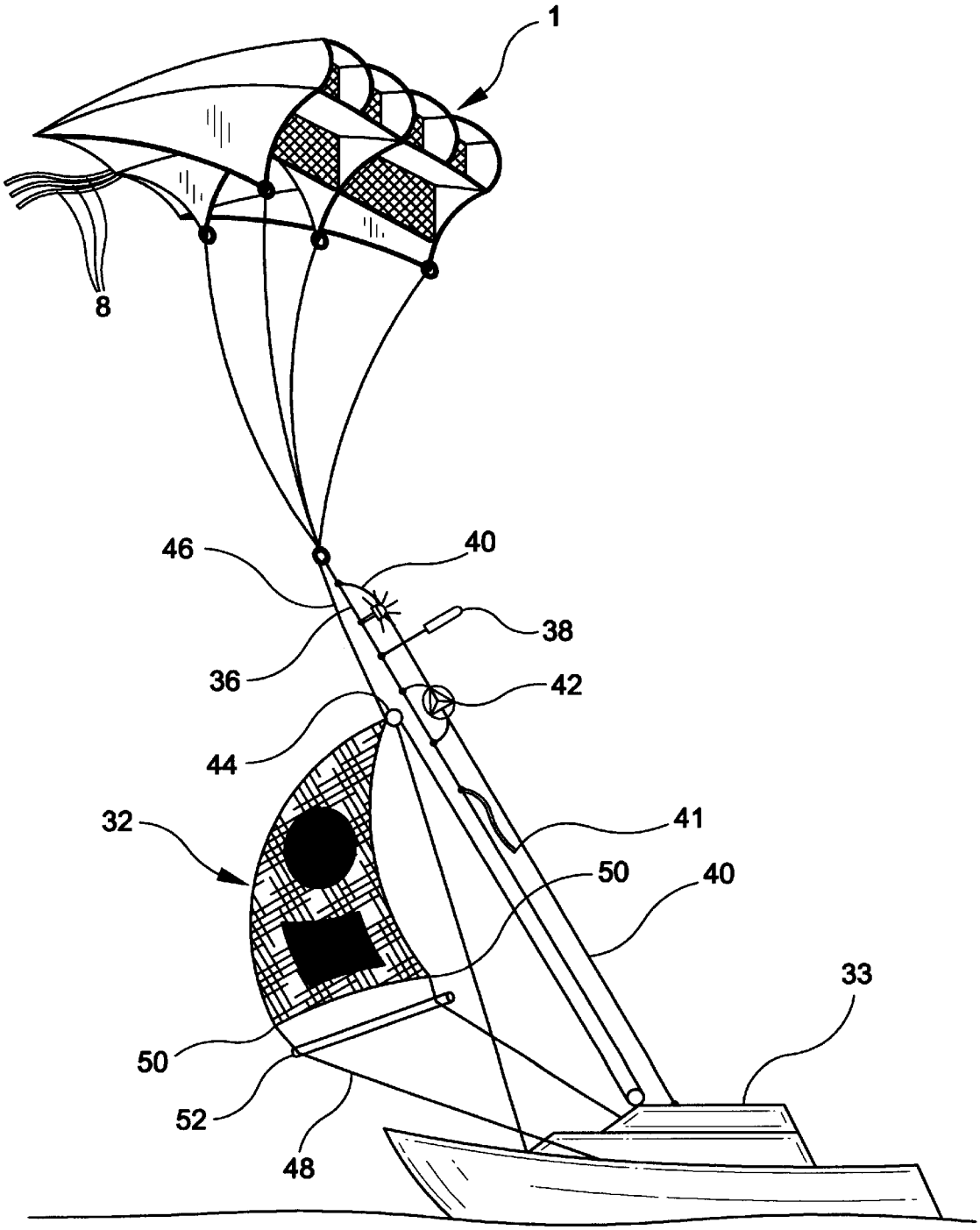
FIG. 1 illustrates several components of the distress signal kit of the inventions of the parent applications in operation—a parafoil with radar reflective tail hoists a spinnaker sail (for propulsion) into the air from a vessel in distress. The parafoil, with or without the spinnaker, acts as a lifting device to carry various distress signals including strobe lights, flares, radio antennae and radar reflectors.

FIG. 1 illustrates embodiments of the invention wherein several components of the distress signal kit are in operation. The parafoil (1) with radar reflective tail (8) hoists spinnaker sail (32) into the air from a vessel (33) in distress. The parafoil and spinnaker in combination can carry multiple distress signals aloft, including battery-powered strobe lights (36), pyrotechnic flares (38), radio antenna (40), radar reflective strips (41) and radar reflectors (42). Various combinations of such distress signals may be used during day or night conditions. Various radar reflectors can be attached, such as the collapsible or foldable sets of three discs of FIG. 2 providing three orthogonal reflective surfaces when assembled (known and commercially available, such as, e.g. the "Davis emergency reflector"). Preferably, collapsible inflatable reflectors are used, as described below.

Figure 2:
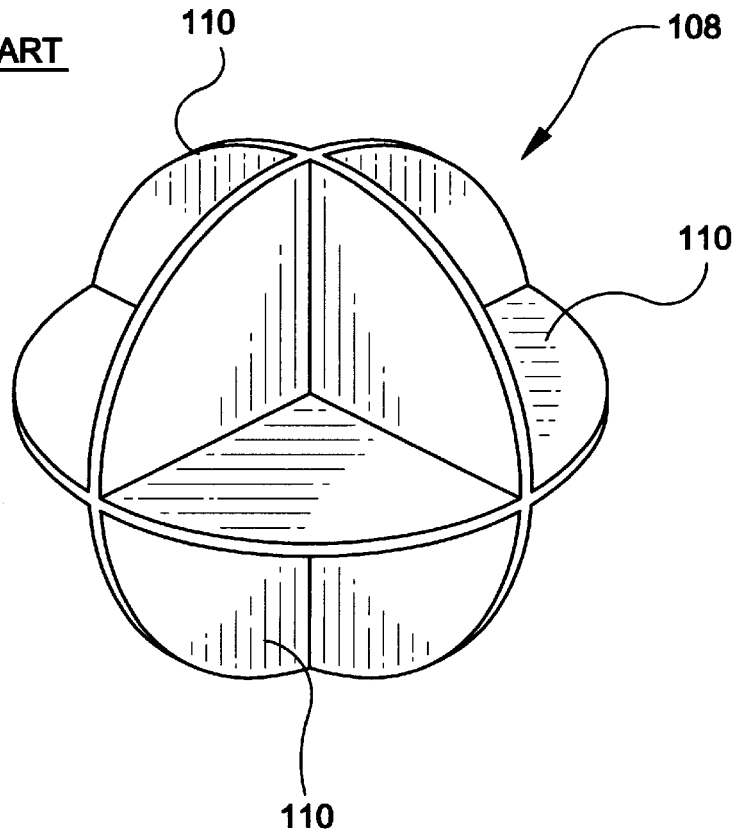
FIG-2 PRIOR ART
FIG. 2 shows a Davis radar reflector with orthogonal reflective surfaces.

FIG. 2 shows a folding orthogonal radar reflector (108) of the prior art assembled. The three discs (110) of radar-reflective material interlock to form a set of three mutually orthogonal planes, all of them radar reflective. Such reflectors are commercially available in a variety of sizes, including, e.g. the Davis models for small boats. The result is to produce omnidirectional retroreflection of radar waves, as discussed above. Although used freely by those skilled in the art, "radar reflective" and "radar-permeable" are qualitative terms. Generally objects having at least a metallic component reflect enough radar waves to provide a discernible signal on a receiver, while radar-permeable objects like cloth, wood or birds allow most radar waves to pass through without significant reflection. Some materials, even metals, can be shaped or coated to absorb or scatter radar waves rather than reflecting them. For the purposes of this application, a radar reflective material is one which provides retroreflection of substantially all impinging radar waves, at least enough to produce a signal in a radar receiver, and a radar-permeable material is one which passes most waves through freely, with minimal reflection.

Figure 3:
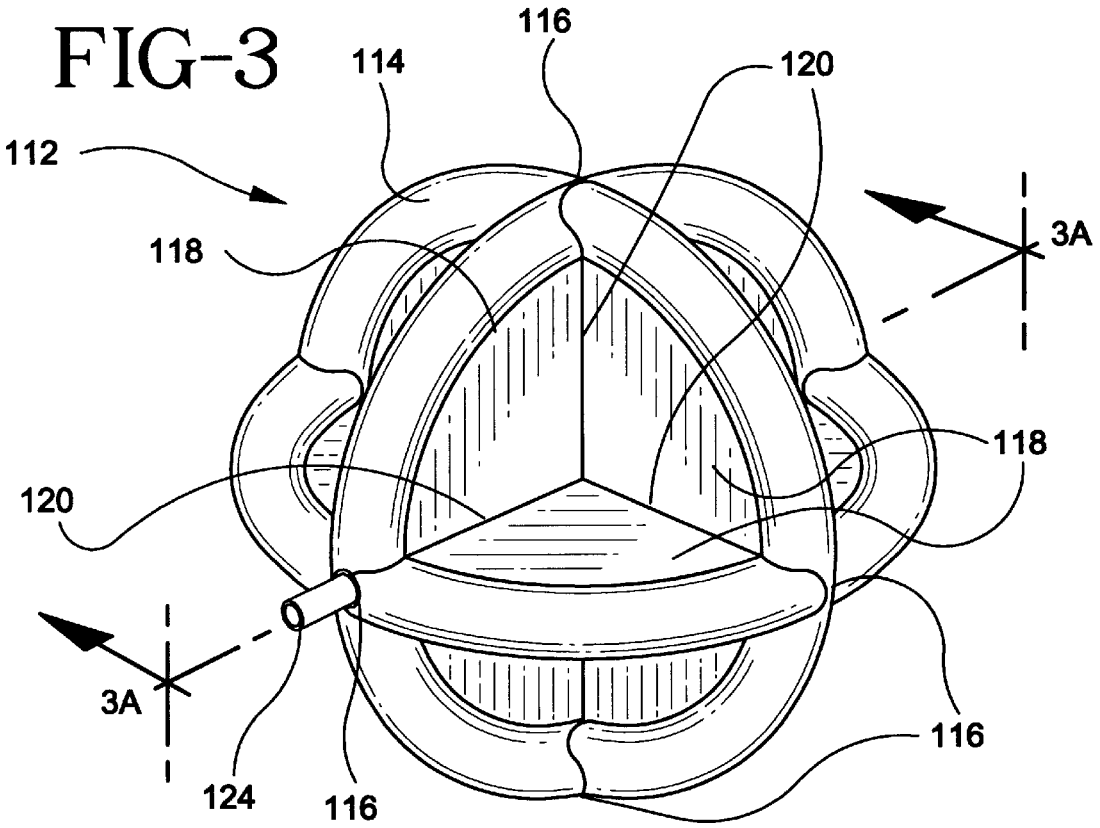
FIGS. 3 (an oblique view) and 3A show Applicant's inflatable radar reflector which can be encased within a balloon.
Figure 3A:
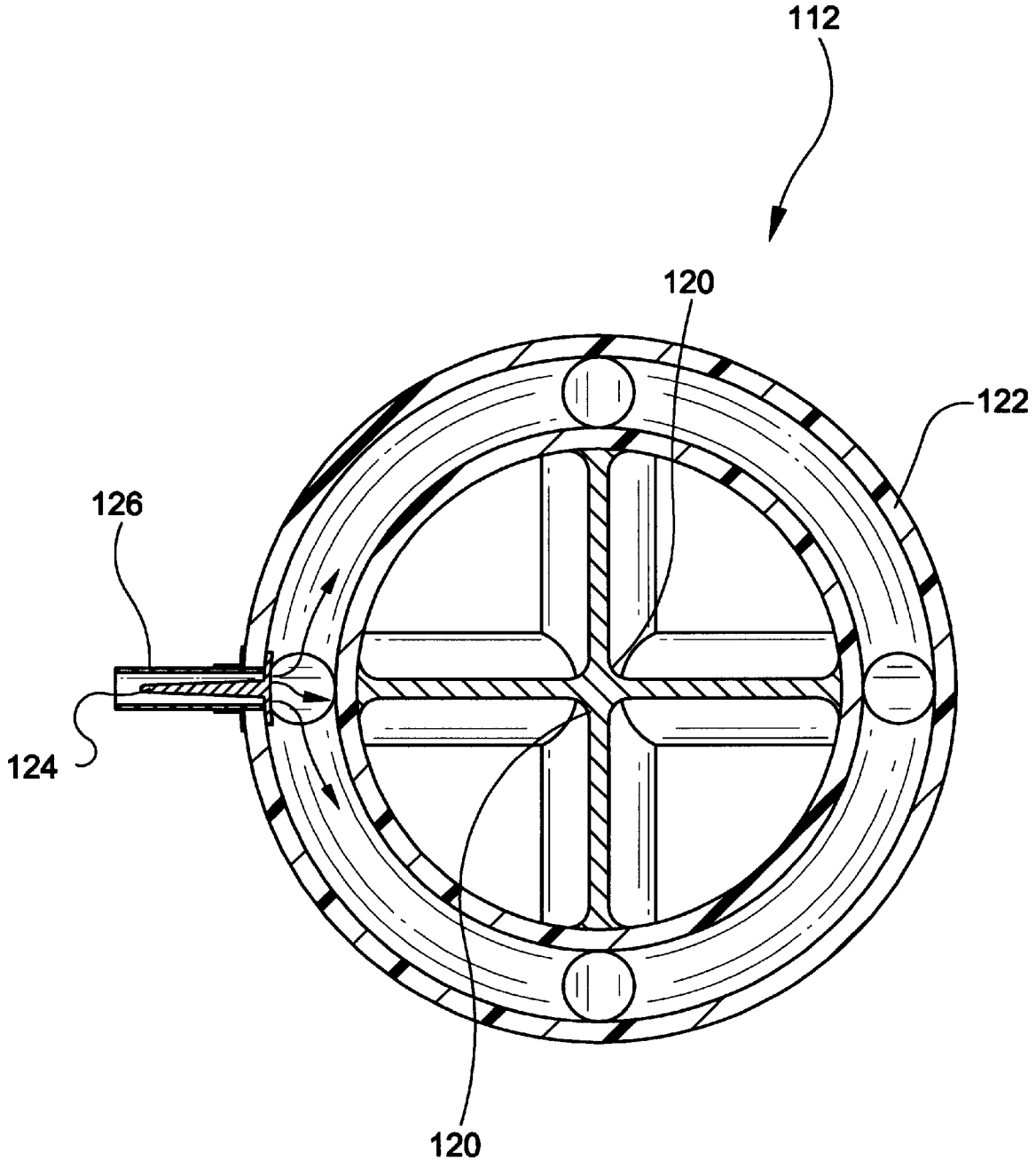

FIGS. 3 and 3A show Applicant's collapsible inflatable radar reflector (112), which also provides three mutually orthogonal reflecting surfaces. The three inflatable hoops (i.e., toruses) (114) are preferably made of elastomeric tubing resembling the tubes for bicycle tires or the like and mutually intersect at points (116) so as to provide a single inflatable air reservoir, with the hoops held in orthogonal position. Thin discs (118) of flexible, radar-reflective material such as aluminized Mylar are fastened securely inside each hoop, mutually intersecting at lines (120) and configured so that the final assembly provides three orthogonal radar-reflective discs. Optionally, to provide protection from the elements and added rigidity for the inflated hoops, the device is encased in a large radar-permeable balloon (122), shown in cross-sectional view in FIG. 3A. The balloon can be either elastomeric or inelastic, but is preferably elastomeric to facilitate collapsing the reflector for storage. The inflation tube (124) of the reflector is led out through the balloon inflation tube (126), so that the reflector unit and balloon may be inflated sequentially or essentially simultaneously. When both units are fully inflated and the inflation tubes secured, the hoops and orthogonal radar reflective surfaces are held firmly in place and protected from the elements. The unit can be collapsed and encased in an envelope or packet for storage in a lifejacket pocket or the like. In conditions of calm or light winds, the unit's hoops and balloon can be at least partially inflated with a lighter-than-air gas such as helium or hydrogen, so that it is buoyant and does not require a lifting device such as the parafoil. Such gases can be provided by small cartridges, gas generators, or any available source.

Figure 4:
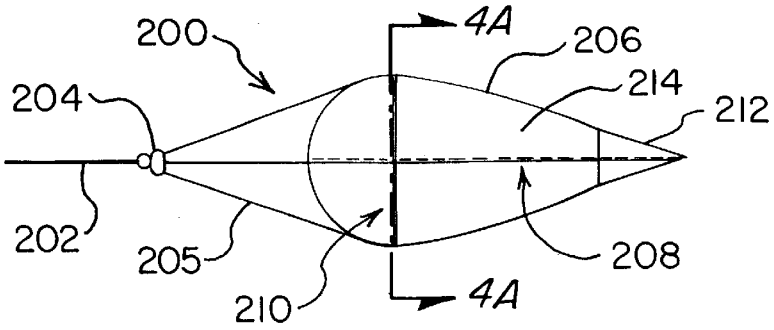
FIGS. 4 and 4A are side and cross-sectional views of a second embodiment of the inflatable radar refelector.
Figure 4A:
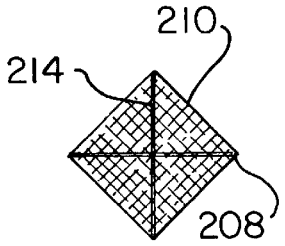
Figure 5:
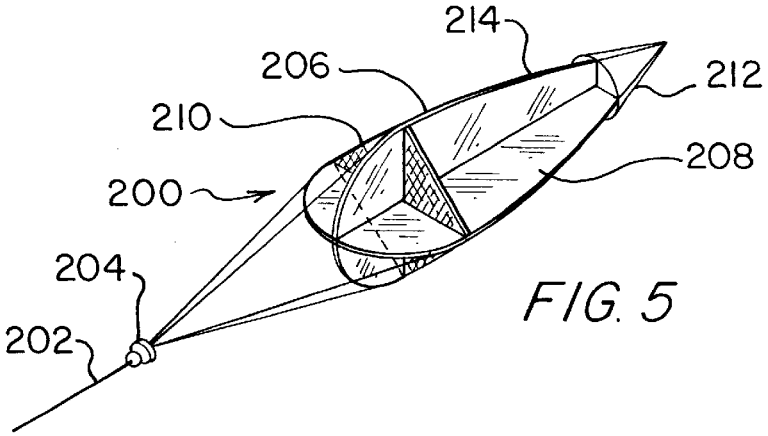
FIG. 5 is an oblique view of the radar reflector of FIGS. 4 and 4A.

FIGS. 4, 4A and 5 illustrate another embodiment of the invention. A teardrop-shaped radar reflector (200) is attached by a harness (205), swivel (204) and line (202) to a stationary or moving object such as the parafoil illustrated in FIG. 1 or an aircraft or other moving vehicle. Optionally, the harness (205) can be attached to the radar reflector (200) in an off-center manner (not shown) so that the reflector meets the impinging airflow at an angle of attack and the components of the reflector thus create lift. Rigid frames (206) and (208), vertical and horizontal in the orientation shown, form two perpendicular intersecting planes, and radar reflective material (214) is stretched across each frame to form perpendicular radar reflective planes. A square of metal screen or metallized fabric mesh (210) is fastened to the two frames to form a third plane (4A—4A) perpendicular to both the planes, thus forming three mutually orthogonal radar reflecting planes. The four sides of metallized mesh square (210) are of equal fixed lengths and help frames (206) and (208) maintain their perpendicular relationship. The tension provided by the fabric mesh also helps to keep the frames (206) and (208) stable and perpendicular. Conical member (212) of fabric or other suitable flexible material will readily inflate when the reflector is towed or directed into the wind, thus keeping the reflector in a relatively stable position. The reflector is thus "inflatable" when exposed to an airflow.

Figure 6:
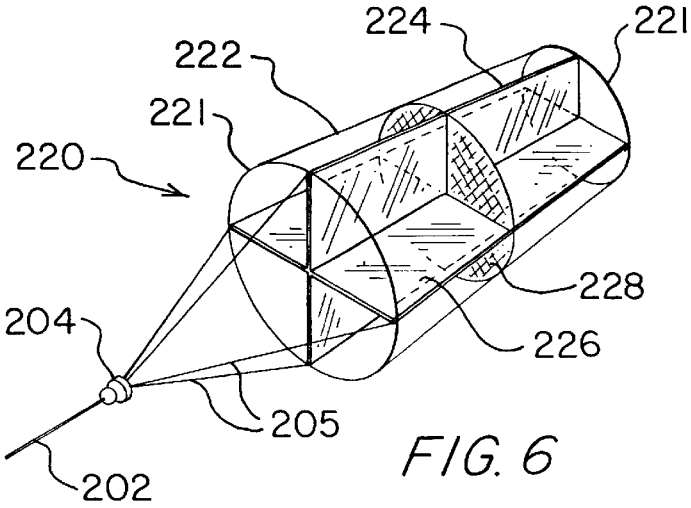
FIGS. 6 and 6A are oblique and cross-sectional views of a third embodiment of the inflatable radar reflector.
Figure 6A:
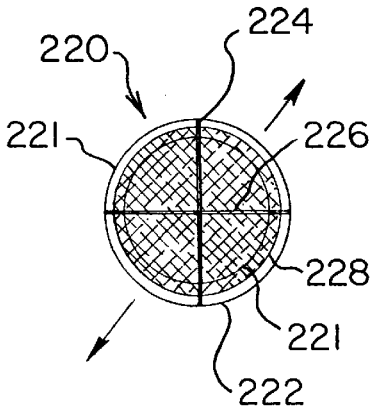

FIGS. 6 and 6A illustrate another embodiment of the invention. A cylindrical drogue reflector (220) is attached to a stationary or moving object by the same line (202), swivel (204) and harness (205) as discussed above. At least two circular rings (221) of metal or other suitable springy material support a radar permeable fabric sleeve (222) which readily inflates when the reflector is positioned in an airflow. Mutually perpendicular lateral planes (224) and (226) are made of radar reflective material. Circular plane (228) is made of radar reflective mesh or screen and is perpendicular to both planes (224) and (226). The result is an inflatable radar reflector having three mutually orthogonal radar reflective planes incorporated in its structure.

It should be apparent from the above descriptions that the present invention provides inflatable radar reflectors which can be used as parafoil-borne distress signals in a variety of contexts from individual use to vessels large or small. Marine applications are particularly noteworthy.

Clearly many modifications and variations of the present invention are possible in view of the above teachings. It is therefore to be understood that the scope of the invention is limited only by the appended claims.

I claim:

1. An inflatable radar reflector which comprises two teardrop-shaped rigid frames intersecting along their longitudinal centerlines and mutually perpendicular, each frame being covered with radar reflective material to form two perpendicular radar reflective planes, further comprising a transverse square member attached to said frames and perpendicular thereto, comprising metallic mesh, wherein said transverse square member helps to keep said rigid frames stable and perpendicular to each other, with a conical inflatable member forming the tail of said reflector, and further comprising attachment means.

2. The radar reflector of claim 1 wherein said two perpendicular radar reflective planes and said transverse square member form mutually orthogonal radar reflective planes.

3. The radar reflector of claim 1 wherein said conical inflatable member is formed of radar-permeable material.

4. An inflatable radar reflector which comprises an open cylinder of radar permeable material supported by at least two springy rings therein, two mutually perpendicular flexible radar reflective surfaces secured within the resulting cylinder and extending at least a portion of said cylinder's length, and a circular radar reflective surface within said cylinder and perpendicular to each of said radar reflective surfaces, and further comprising attachment means.

5. The radar reflector of claim 4 wherein at least said circular radar reflective surface comprises radar reflective mesh and optionally said two perpendicular radar reflective surfaces also comprise radar reflective mesh.

6. A collapsible inflatable radar reflector comprising three hollow tori of elastomeric, radar-permeable material which mutually intersect in a manner such that their planes are mutually orthogonal and each intersection provides a passage for air to pass between the intersecting sections thereof, inflation means for filling the three tori simultaneously, collapsible circular panels of radar-reflective material covering each torus such that they form mutually orthogonal radar reflective planes, and attachment means.

7. The inflatable radar reflector of claim 6 which is encased in an inflatable balloon of radar-permeable material having inflation means such that the inflation means of said radar reflector emerges concentrically from the inflation means of said balloon and the two units can be inflated substantially simultaneously.

8. The inflatable radar reflector of claim 7 wherein said balloon comprises elastomeric material.

9. The inflatable radar reflector and balloon of claim 7, wherein at least one of said reflector and said balloon are inflated with a lighter-than-air gas.

* * * * *